US005110136A

United States Patent [19]

Land

[11] Patent Number: 5,110,136

[45] Date of Patent: May 5, 1992

[54] FISHING CASTING PRACTICE DEVICE

[76] Inventor: David Land, 10907 E. 68th St., Tulsa, Okla. 74133

[21] Appl. No.: 667,003

[22] Filed: Mar. 11, 1991

[51] Int. Cl.[5] ..... A63B 69/00

[52] U.S. Cl. ..... 273/346; 273/140

[58] Field of Search ..... 273/346, 347, 140

[56] References Cited

U.S. PATENT DOCUMENTS

| | | | |
|---|---|---|---|
| 1,199,183 | 9/1916 | Hill . | |
| 2,598,487 | 5/1952 | Anechiarico | 273/149 |
| 2,611,617 | 9/1952 | Strohm | 272/140 |
| 3,032,345 | 5/1962 | Lemelson | 273/346 |
| 3,370,853 | 2/1968 | Feld et al. | 274/346 |
| 3,463,494 | 8/1969 | Stroh | 273/101 |
| 3,620,532 | 11/1971 | Graf | 273/1 |
| 3,788,641 | 1/1974 | Lemelson | 273/140 X |
| 3,857,566 | 12/1974 | Lemelson et al. | 273/346 |
| 3,864,872 | 2/1975 | Hoetzel | 46/241 |
| 4,447,060 | 5/1984 | Guinn | 273/346 |
| 4,744,565 | 5/1988 | Newberger | 273/342 |

*Primary Examiner*—William H. Grieb
*Attorney, Agent, or Firm*—Head & Johnson

[57] ABSTRACT

A fishing casting practice device for use with a fishing rod having extending fishing line. The device includes at least one casting target having contact engaging material on the exterior thereof. A lure replacement projectile has a line connection mechanism to secure an end of the fishing line to the lure replacement projectile. At least a portion of the lure replacement projectile is covered with hook engaging material capable of engaging the contact engaging material on the target when brought into contact therewith.

2 Claims, 2 Drawing Sheets

FISHING CASTING PRACTICE DEVICE

BACKGROUND OF THE INVENTION

1. Field of the Invention

The present invention relates to a fishing casting practice device to develop skill and accuracy in casting a lure to a desired location and to provide a recreational activity.

2. Prior Art

Developing the skill required in casting a lure or bait with a fishing rod and reel takes a considerable amount of practice. Bringing the rod back above the head and then forward while releasing the fishing line at the proper time to propel the lure or bait forward to the desired location requires hand/eye coordination.

Various devices and toys are known to teach and practice casting of a lure with a fishing pole. Some of these devices utilize hooks engagable with rings or eyes while others utilize magnets engagable with metal members. In each case, the devices include relatively heavy metal members or hook members.

Applicant is aware of the following U.S. patents:

| INVENTOR | U.S. Pat. No. |
|---|---|
| Guinn | 4,447,060 |
| Hill | 1,199,183 |
| Strohm | 2,611,617 |
| Newberger | 4,744,565 |
| Stroh | 3,463,494 |
| Anechiarico | 2,598,487 |
| Hoetzel | 3,864,872 |
| Graf | 3,620,532 |

Stroh (U.S. Pat. No. 3,463,494) discloses a casting and fish retrieving device. A fisherman casts a member which represents a head portion of a fish, and if accurately cast, magnetically engages a member representing the tail portion of the fish, which is accommodated in a casing having an upwardly facing V-notch.

Anechiarico (U.S. Pat. No. 2,598,487) discloses a magnet suspended from a fishing line engageable with an artificial fish having metallic members.

Hoetzel (U.S. Pat. No. 3,864,872) discloses a hollow handle and rod which has a line magnet at one end of the line engaging an artificial fish with a metallic portion.

Graf (U. S. Pat. No. 3,620,532) discloses an imitation fish having apertures of various diameters which mate With spherical lures of varying diameters.

Guinn (U.S. Pat. No. 4,447,060) discloses a disk shaped projectile having VELCRO material adapted to be hurled and engaged with a target having a face provided with VELCRO engaging material. Additional projectiles can be hurled toward the target or toward the engaged projectiles in order to stack thereon.

None of the known devices provides a fishing casting practice device to be used with a rod and reel that is simple in construction, devoid of hooks or heavy metal members, and that may be used either in the water or on the land.

Accordingly, it is a principal object and purpose of the invention to provide a device to be used with a rod and reel that is simple in construction, devoid of hooks or heavy metal members, and may be used either in the water or on the land.

SUMMARY OF THE INVENTION

The present invention provides a fishing casting practice device to be used to develop and enhance the skill of casting with a fishing rod and reel. The present invention may be used with nearly any fishing rod and reel having line extending therefrom.

At the end of the line is secured a lure or bait replacement projectile. The projectile has a mechanism to secure the line thereto such as an eyelet. The projectile will be relatively lightweight with no hooks or sharp edges.

In the present embodiment, the projectile is cylindrical in shape with an eyelet extending from one end of the cylinder. The walls of the cylinder projectile are covered with hook engaging material which may be secured to the projectile by adhesive.

A number of casting targets are arranged at a distance from the fisherman. Each casting target is relatively flat and covered with a contact engaging material, such as felt. When the lure replacement projectile is cast by the fisherman, the projectile will secure itself to the target when it comes in contact therewith.

The casting target may then be reeled in by use of the rod and reel.

DETAILED DESCRIPTION OF THE PREFERRED EMBODIMENTS

Figure 1:
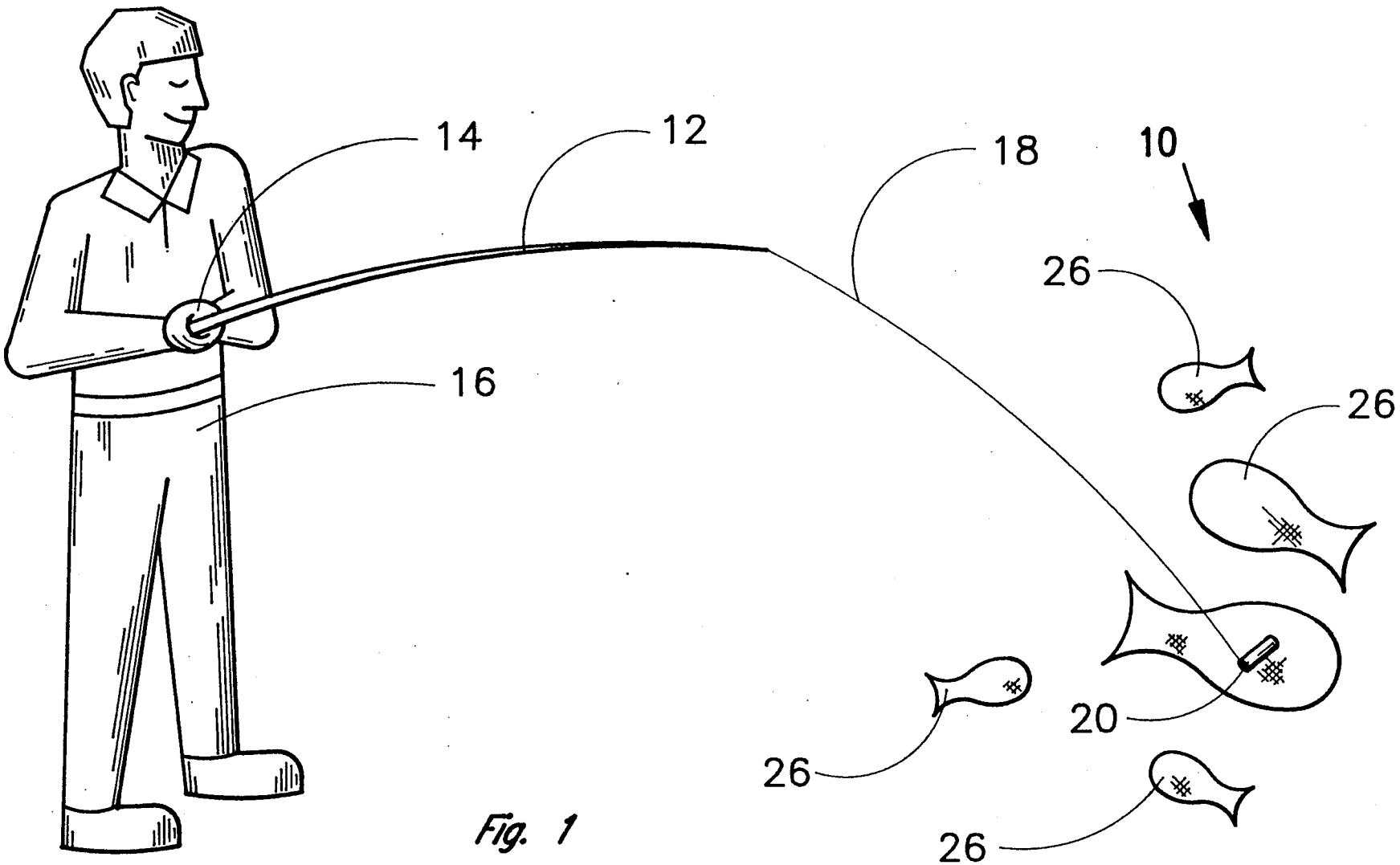
FIG. 1 is a perspective view of a fisherman holding a rod and reel which has been provided with the fishing casting practice device constructed in accordance with the present invention.

Referring to the drawings in detail, FIG. 1 illustrates a fishing casting practice device 10 to be used to develop and enhance the skill of a fisherman in casting with a fishing rod 12 and reel 14.

In the usual manner, a line 18 extends from the reel 14 through eyelets (not shown) along the rod. It will be recognized that the present invention will work equally well with various types of rods and reels.

The procedure of casting used when fishing is fairly standard. In order for a fisherman 16 to cast a lure or bait (not shown), a length of line 18 is normally allowed to extend from the end of the rod 12. Holding the rod in one hand, the opposite end of the rod is raised above the fisherman's head and then moved quickly forward in the direction of the desired target or location. At the same time, a length of line is released so that the lure or bait at the end thereof is propelled forward toward the desired target or location.

The procedure of casting requires a considerable amount of hand and eye coordination. The present invention will be used in place of the actual lure and bait to develop skill in casting and, at the same time, provide a recreational activity that may be enjoyed indoors or outdoors, on the land on in the water.

The present invention may be used with nearly any fishing rod 12 and reel 14 having line 18 extending therefrom. At the end of the line 18 is secured a lure or bait replacement projectile 20. The projectile will be used in leiu of the actual lure or bait.

The projectile 20 has a mechanism to secure the line 18 thereto, in this case an eyelet 22 which will receive the line therethrough. The line is then secured to the eyelet by a knot or knots. It will be recognized that other mechanisms might be substituted for the eyelet, such as clips to secure the projectile 20 to the end of the line 18.

The projectile 20 will be relatively lightweight with no hooks or sharp edges. In the present embodiment, a projectile approximately one ounce in weight has been found to be satisfactory.

Figure 2:
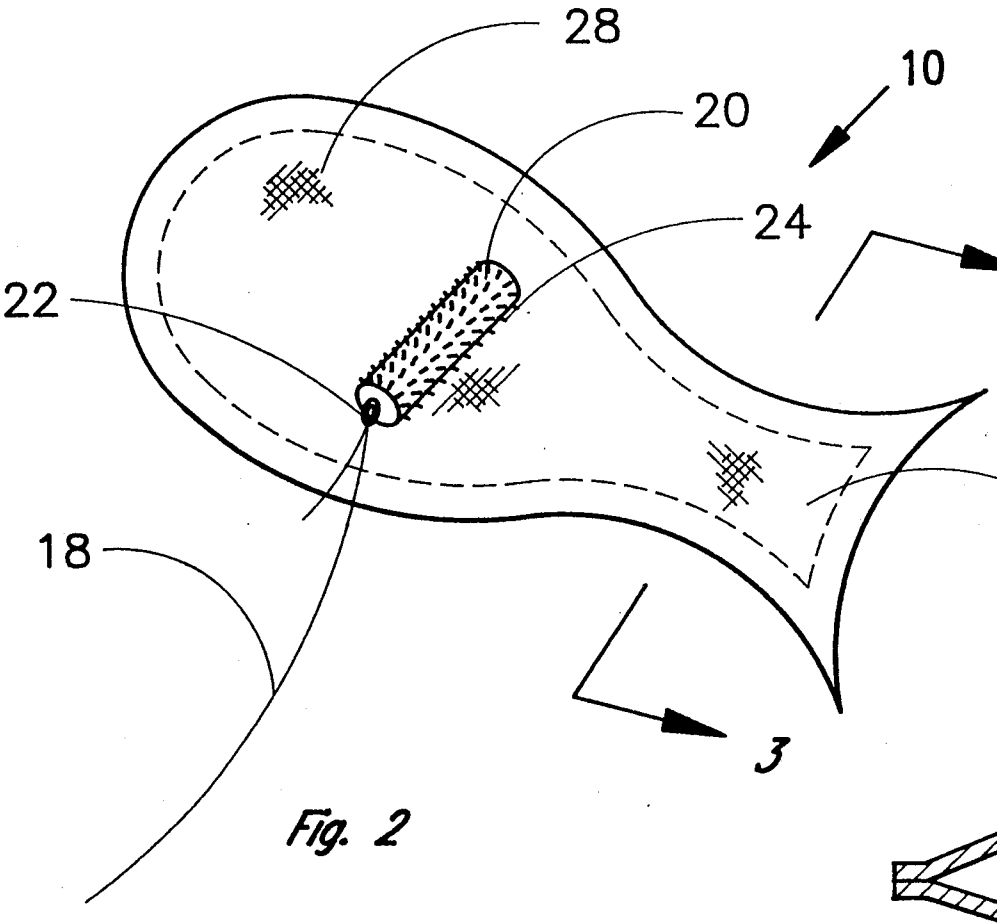
FIG. 2 is a perspective view of the fishing casting practice device as seen in FIG. 1.

As best seen in FIG. 2, the projectile 20 is cylindrical in shape. The projectile would also operate effectively if constructed in other shapes, such as circular. The cylindrical projectile 20 might be constructed of wood, rubber, plastic or other lightweight material. The eyelet 22 extends from one end of the cylinder.

The walls of the cylindrical projectile 20 are covered with hook engaging material 24. This hook engaging material 24 is known in various forms and is commercially available in one form under the trademark VELCRO. The hook engaging material 24 may be secured to the projectile by adhesive (not shown) or other means.

The projectile 20 may be cast by the fisherman 16 with the rod and reel without fear of catching a hook on fisherman or others and without fear of damaging breakable objects.

In order to focus the fisherman's attention and to provide a target, a number of casting targets 26 may be arranged at a suitable distance from the fisherman 16. The distance of the targets from the fisherman and the arrangement of the targets is a matter of choice.

In the present embodiment, the casting targets have the general outline and shape of a fish. Other shapes are, of course, possible. The casting target is relatively flat and is covered with a contact engaging material 28. The contact engaging material 28 will operate with the hook engaging material 24 so that the projectile 20 will be secured to a target 26 when it comes into contact with the contact engaging material 28.

In operation, the fisherman will cast the projectile toward the target 26. If the projectile comes into contact with the target, it will adhere to the target. If the fisherman proceeds to wind the reel and retract the line 18, the target 26 will be retrieved and drawn toward the fisherman.

The projectile may be quickly and easily separated from the target so that the projectile may be cast again and the procedure repeated.

Figure 3:
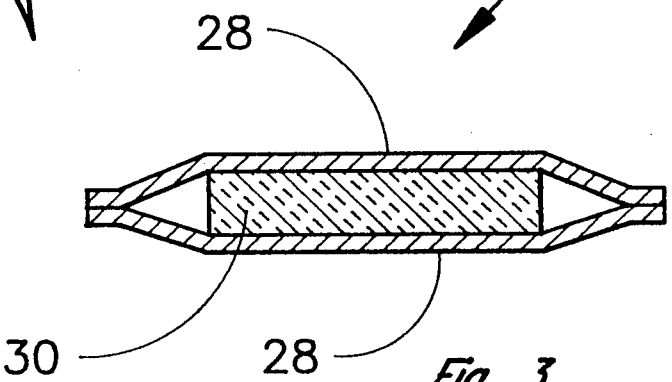
FIG. 3 is a sectional view taken along section 3—3 of FIG. 2.

FIG. 3 is a sectional view taken along section line 3—3 of FIG. 2. The casting target has a pair of contact engaging material faces 28 which are secured together at their edges by thread or otherwise. Interior to the target is a buoyant filler 30. Use of the buoyant filler 30 allows the target to be floated in the water. Accordingly, the fisherman may cast the projectile 20 in a pond or pool (not shown) wherein the targets are placed.

The targets may be constructed in various sizes and may have different colored materials. To add to the enjoyment and challenge of the device, differing points may be assigned to targets of different colors or sizes.

It will be appreciated that the present device provides a safe and fun casting practice device, not only for adults but for children as well.

Whereas, the present invention has been described in relation to the drawings attached hereto, it should be understood that other and further modifications, apart from those shown or suggested herein, may be made within the spirit and scope of this invention.

What is claimed is:

1. A fishing casting practice device for use with a fishing rod having extending fishing line, which device comprises:

at least one casting target having contact engaging material on substantially the entire exterior thereof and containing buoyant material encased within said contact engaging material so that each said target may float on water; and a lure replacement projectile having line connection means to secure an end of said fishing line to said lure replacement projectile, at least a portion of said lure replacement projectile covered by hook engaging material capable of engaging said contact engaging material on said target when brought into contact with any part of said target.

2. A fishing casting practice device for use with a fishing rod having extending fishing line, which device comprises:

at least one casting target having contact engaging material on substantially the entire exterior thereof; and a lure replacement projectile in the shape of a cylinder, said projectile having line connection means to secure an end of said fishing line to said lure replacement projectile, wherein the walls of said lure replacement projectile are covered by hook engaging material capable of engaging said contact engaging material on said target when brought into contact with any part of said target.

* * * * *